US007931794B2

(12) United States Patent
Happer et al.

(10) Patent No.: US 7,931,794 B2
(45) Date of Patent: Apr. 26, 2011

(54) METHOD AND SYSTEM FOR ELECTROLYTIC FABRICATION OF ATOMIC CLOCK CELLS

(75) Inventors: William Happer, Princeton, NJ (US); Yuan-Yu Jau, Princeton, NJ (US); Fei Gong, Princeton, NJ (US); Katharine Estelle Jensen, Cambridge, MA (US)

(73) Assignee: Princeton University, Princeton, NJ (US)

( * ) Notice: Subject to any disclaimer, the term of this patent is extended or adjusted under 35 U.S.C. 154(b) by 1180 days.

(21) Appl. No.: 11/591,909

(22) Filed: Nov. 2, 2006

(65) Prior Publication Data

US 2010/0084284 A1 Apr. 8, 2010

Related U.S. Application Data

(60) Provisional application No. 60/732,991, filed on Nov. 3, 2005, provisional application No. 60/760,141, filed on Jan. 19, 2006.

(51) Int. Cl.
*C25C 3/02* (2006.01)

(52) U.S. Cl. ..... 205/406; 205/407; 205/408; 205/409

(58) Field of Classification Search ..... 205/59, 205/57
See application file for complete search history.

(56) References Cited

U.S. PATENT DOCUMENTS 6,811,916 B2 * 11/2004 Mallari et al. ..... 429/510
7,018,607 B2 * 3/2006 Nazri et al. ..... 423/593.1
2001/0041294 A1 * 11/2001 Chu et al. ..... 429/231.9

OTHER PUBLICATIONS

Burt, Robert Cady, Sodium by Electrolysis Through Glass, Electronic Theses, Jan. 1, 1926, http://resolver.caltech.edu/CaltechETD:etd-11022004-131239.

* cited by examiner

*Primary Examiner* — Arun S Phasge
(74) *Attorney, Agent, or Firm* — Porzio, Bromberg & Newman, P.C.

(57) ABSTRACT

The present invention relates to a method and system for electrolytic fabrication of cells. A cell can be formed of a silicon layer (cathode) sandwiched between layers of glass. One or more holes are formed in the silicon layer. An alkali metal enriched glass material is placed in or associated with the one or more holes. Electrolysis is used to make the alkali metal ions in the alkali metal enriched glass material combine with electrons from the silicon cathode to form neutral alkali metal atoms in the one or more holes.

34 Claims, 12 Drawing Sheets

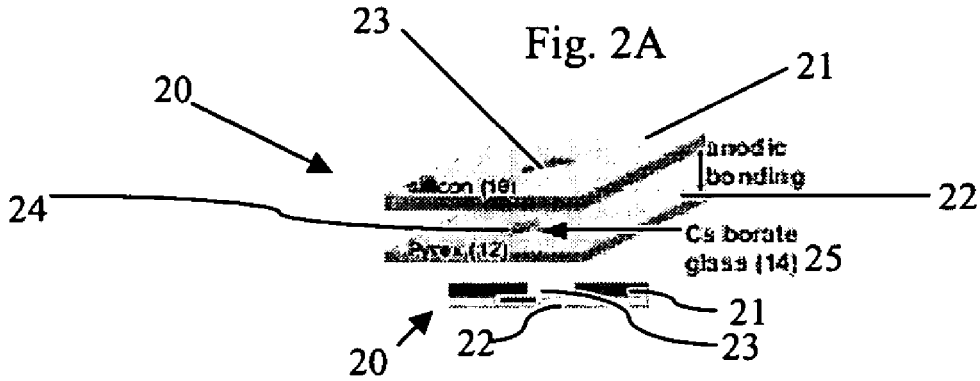
Fig. 2A
Fig. 2B
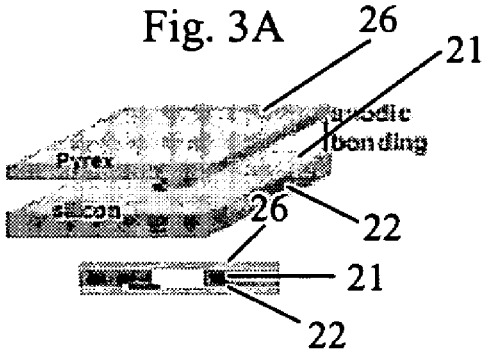
Fig. 3A
Fig. 3B

50

METHOD AND SYSTEM FOR ELECTROLYTIC FABRICATION OF ATOMIC CLOCK CELLS

CROSS REFERENCE TO RELATED APPLICATION

This application claims the benefit of U.S. Provisional Patent Application No. 60/732,991, filed Nov. 3, 2005 and U.S. Provisional Patent Application No. 60/760,141, filed Jan. 19, 2006, the entirety of both of which are hereby incorporated by reference into this application.

STATEMENT OF GOVERNMENT FUNDED RESEARCH

This work was supported by the Air Force Office Scientific Research FA9550-04-1-0199. Accordingly, the Government has certain rights in this invention.

BACKGROUND OF THE INVENTION

1. Field of the Invention

The present invention relates to a method and system for fabrication of atomic cells and more particularly to a method for electrolytically releasing controlled amounts of free alkali metal into an atomic clock cell formed of a silicon wafer anodically bonded to glass layers 2. Description of Related Art Miniature cells for atomic clocks have been formed by anodically bonding glass wafers to both sides of a silicon wafer, containing many small holes. Each of these small holes is destined to be a vapor cell. Many hundreds of cells can be mass produced on a single silicon wafer. Each cell can be integrated with, for example, a vertical cavity surface emitting laser (VCSEL), a photodetector, electronics, and a thermal control system.

Conventional methods have been used to fill the anodically bonded cells with Rb or Cs metal. In one method, small holes are opened through a glass window into each cell, for example with a focused laser, a small amount of liquid Cs or Rb metal is injected with a tiny syringe or an array of syringes, along with an appropriate mixture and pressure of buffer gases. The hole is then hermetically sealed.

In a second method, each cell is manufactured with a mixture of alkali-metal salt and reducing agents that can release the Cs or Rb metal into the cell after appropriate thermal processing. When the mixture is subsequently heated to several hundred degrees Celsius, the chemical components react releasing free alkali metal and nitrogen gas. It is not easy to control the gas composition in this process, and the cell can also be contaminated with reaction products, which can affect the vapor pressure of the alkali-metal atoms and can degrade the optical properties of the cell. Both methods appear to have limitations for scaling to mass production.

It is desirable to provide an improved method in which controlled amounts of alkali metal can be released into miniature cells using an electrolytic current which method can be used for mass production of cells with reduced manufacturing costs.

SUMMARY OF THE INVENTION

The present invention relates to a method and system for electrolytic fabrication of cells. A cell can be formed of a silicon layer (cathode) sandwiched between layers of glass.

One or more holes are formed in the silicon layer. An alkali metal enriched glass material is placed in or associated with the one or more holes.

Electrolysis is used to make the alkali metal ions in the alkali metal enriched glass material combine with electrons from the silicon cathode to form neutral alkali metal atoms in the one or more holes of the cell. Electron transfer can be by direct contact between the silicon and the glass or indirect contact through a plasma that is maintained in a buffer gas within the cell. In one method, sodium ions of the glass layer are exchanged with desired ions. The ion exchange can be accomplished either by free diffusion of the desired ion from a molten salt, for example, $NaNO_3$ into the glass, or by field-assisted diffusion where a positive potential is maintained between the molten salt and the glass.

The invention will be more fully described by reference to the following drawings.

BRIEF DESCRIPTION OF THE DRAWINGS

FIG. 2A is a schematic perspective view of an open cell including a well containing alkali metal enriched glass.

FIG. 2B is a side elevational view of the cell shown in FIG. 2A.

FIG. 3A is a schematic perspective view of a closed cell.

FIG. 3B is a side elevational view of the cell shown in FIG. 3A.

DETAILED DESCRIPTION

Figure 1:
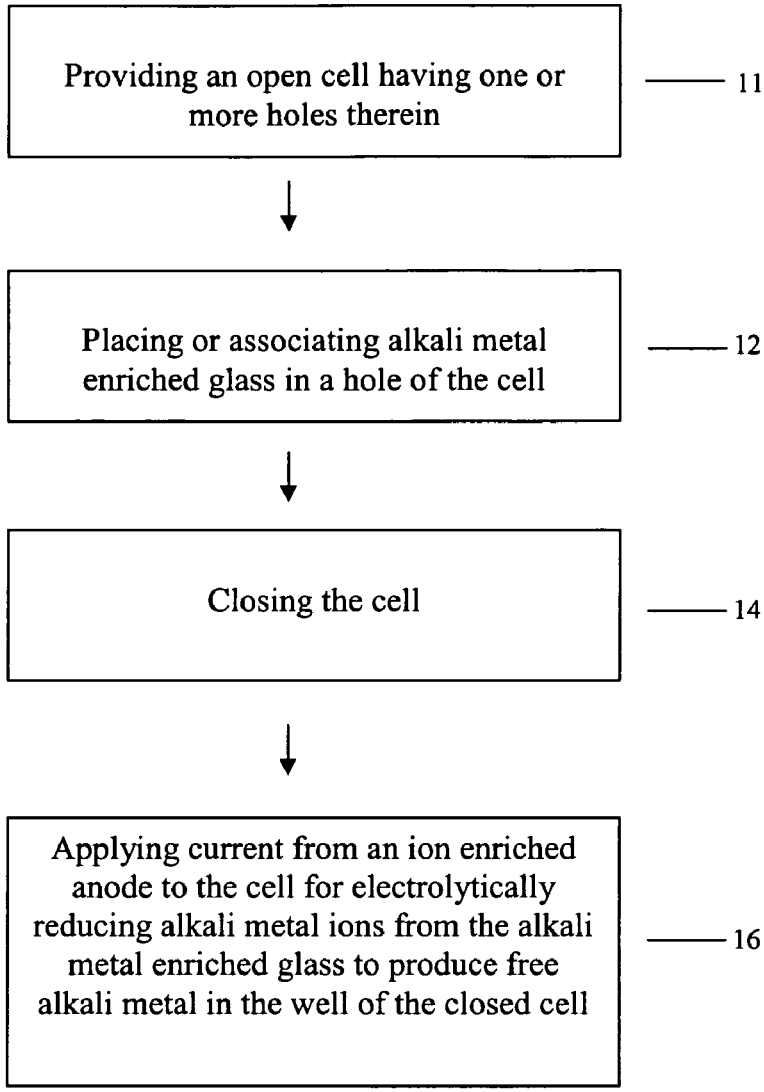
FIG. 1 illustrates a flow diagram of a method for fabrication of atomic clock in accordance with the teachings of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 illustrates a flow diagram of a method for fabrication of cell 10?? in accordance with the teachings of the present invention. In block 11, an open cell having one or more holes therein is provided. An example open cell 20 is shown in FIG. 2A-2B.

Open cell 20 comprises silicon layer 21 anodically bonded to glass layer 22. For example, silicon layer 21 can be a silicon wafer with a thickness of about 2.5 mm and polished on both sides. The silicon wafer can be p-doped and can have a resistivity ≧about 1 ohm $cm^2$. Hole 23 can be formed in silicon layer 21. For example, hole 23 can be formed by drilling a hole in silicon layer 21. Hole 23 can have an example diameter of about 2.5 mm. A suitable glass layer 22 contains sodium ions. For example glass layer 22 can be formed of a borosilicate glass comprising sodium oxide, for example, Pyrex® glass, a trademark of Corning Glassworks. Alternatively, glass layer 22 can be any type of glass which is suitable for anodic bonding. In one embodiment, one or more wells 24 can be formed in glass layer 22. For example, well 24 can have a diameter of about 2.5 mm. Each well 24 is positioned beneath a respective hole 23.

Silicon layer 21 can be anodically bonded to glass layer 22 by pressing the layers together on a graphite disc (not shown), heating the assembly between about 300° C. and about 500° C. and applying a potential difference between silicon layer 21 and the graphite disc. Glass layer 22 contains sodium ions which at the elevated temperature are displaced from the bonding surface of glass layer 22 by the applied electrical field. The depletion of sodium ions near the surface of glass layer 22 makes the surface highly reactive with the silicon surface of silicon layer 21 forming a chemical bond.

Referring to FIG. 1, in block 12, alkali metal enriched glass is placed or associated with a hole of the cell. For example, alkali metal enriched glass 25 is placed in hole 23 and/or well 24, as shown in FIG. 2A. Example alkali metal ions used in alkali metal enriched glass 25 include $Cs^+$, $Rb^+$, $K^+$ and $Na^+$. In one embodiment, the alkali metal enriched glass 25 comprises fragments of cesium-enriched glass formed by melting a mixture of cesium carbonate and boron oxide, for example, at about 900° C. for about 30 minutes. It is desirable that alkali metal enriched glass 25 has nearly the same coefficient of thermal expansion as glass layer 22 to avoid cracking when the cell is heated or cooled. To allow glass layer 22 to provide a window with good optical quality, well 24 can be displaced from hole 23 in silicon layer 21 by about 2 mm, so that most of the cell window is not obscured by the cracks in the Cs-enriched glass.

Referring to FIG. 1, in block 14, the cell is closed. For example, open cell 20 can be closed be attaching glass layer 26 to silicon layer 21, as shown in FIGS. 3A-3B. A suitable glass layer 26 contains sodium ions. Glass layer 26 can be anodically bonded to silicon layer 21 under a buffer gas which is received in one or more holes 23. Example buffer gasses include argon, nitrogen, xenon and mixtures thereof. In one embodiment, nearly pure argon gas at room temperature and pressure of about 0.4 atmospheres can be used. Alternatively, appropriate mixtures of argon with nitrogen gas can be used in an application of use of the cell in an atomic clock to diminish the sensitivity of the clock frequency to temperature fluctuations and to suppress radiation trapping.

Figure 4A:
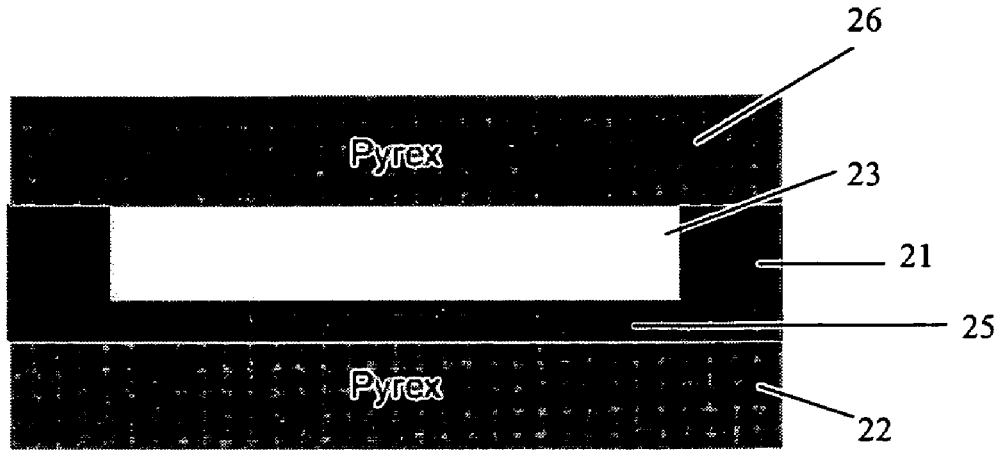
FIG. 4A is a side elevational view of a closed cell including a layer of alkali metal enriched glass fused to the inner surface of a bottom glass layer.
Figure 4B:
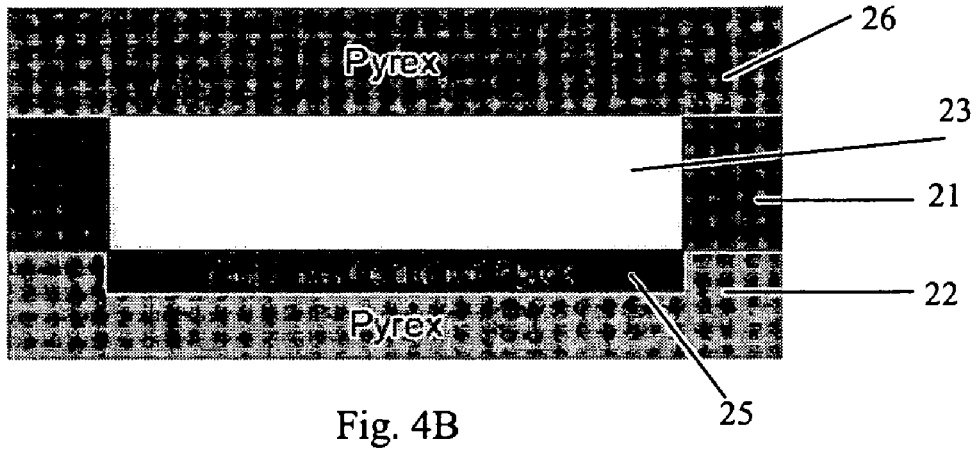
FIG. 4B is a side elevational view of the closed cell including a bottom glass layer doped with alkali metal atoms.

In one embodiment, cell 20 can be heated, in either an open or closed condition, to melt alkali metal enriched glass 25 for making contact with glass layer 22, as shown in FIG. 4A. In an alternate embodiment, glass layer 22 is doped with alkali metal atoms to allow the alkali metal atoms to be associated with hole 23, as shown in FIG. 4B and described in block 12 of FIG. 1.

Figure 5:
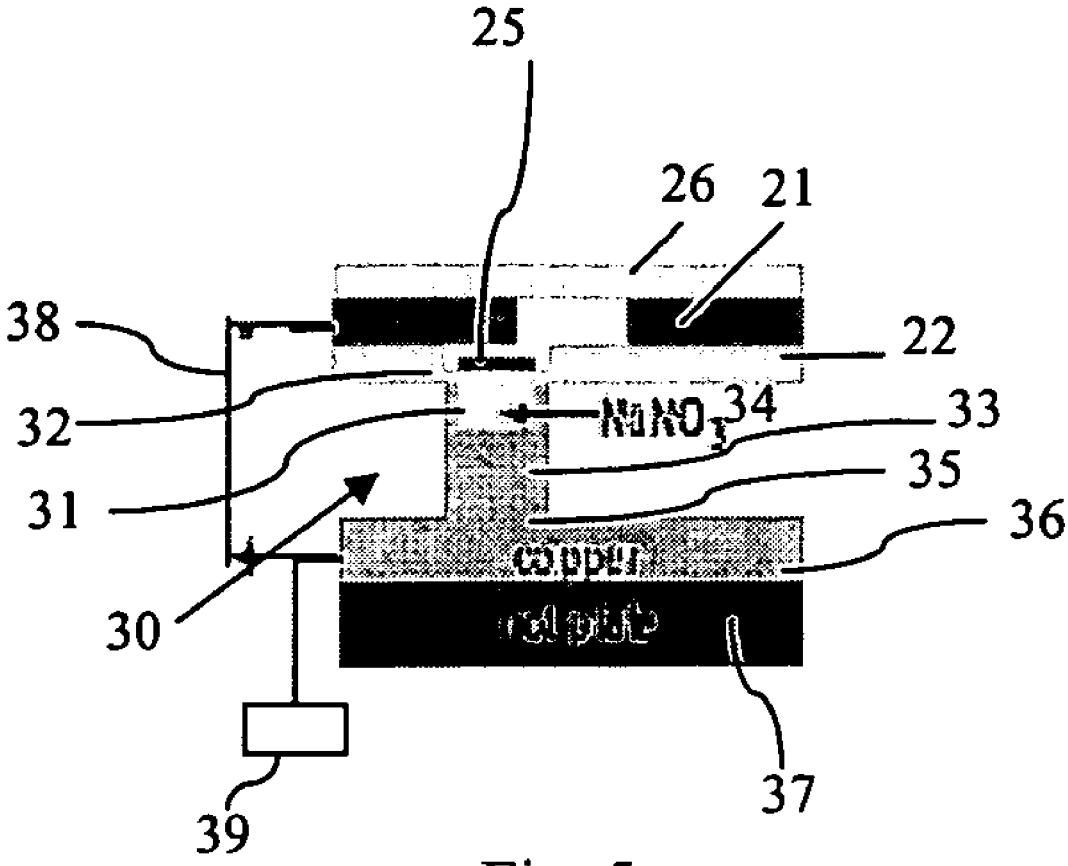
FIG. 5 is a side elevational view of the closed cell including an ion anode and current source.

Referring to FIG. 1, in block 16, a current is applied from an ion anode to the silicon layer of the cell operating as a cathode. An example ion anode 30 is shown in FIG. 5. Basin 31 at top of stem 33 contains molten salt 34. For example, stem 33 can be formed of copper. Molten salt 34 can provide a source of $Na^+$ ions. For example, molten salt 34 can be a $NaNO_3$ salt. Ion anode 30 is centered below glass layer 22 under silicon layer 21 including alkali metal enriched glass 25 within hole 23 and/or well 24. Bottom 35 of stem 33 is attached to base 36 resting on hotplate 37. For example, base 36 can be formed of copper. Molten salt 34 provides ions for injection into glass layer 22. For example, a salt of a molten $NaNO_3$, which melts at 307° C., provides $Na^+$ ions for injection into the glass. The temperature of hot plate 37 can be set at a temperature above the melting temperature of molten salt 34. For example, the temperature of hotplate 37 was set at about 540° C. and thermal equilibrium was established. Thereafter, high voltage power supply 38 was applied. For example, high voltage power supply 38 can increase the voltage gradually to about 700 V. The current can be monitored with a current meter 39. The electrolysis current needed to reduce the alkali-metal ions to free atoms is provided by a DC voltage, and the corresponding electrolysis current I is measured by current meter 39. The number N of alkali-metal ions that are reduced by a constant current I flowing for a time t is $N=It/e$ where $e=1.6\times10^{-19}$ amp sec is the elementary charge. The amount of metal released can be accurately controlled since it is proportional to the electrolytic charge transfer (current times time).

Cell 20 can be used for an atomic clock or atomic magnetometer and other devices that use alkali-metal vapor in a cell.

Figure 6:
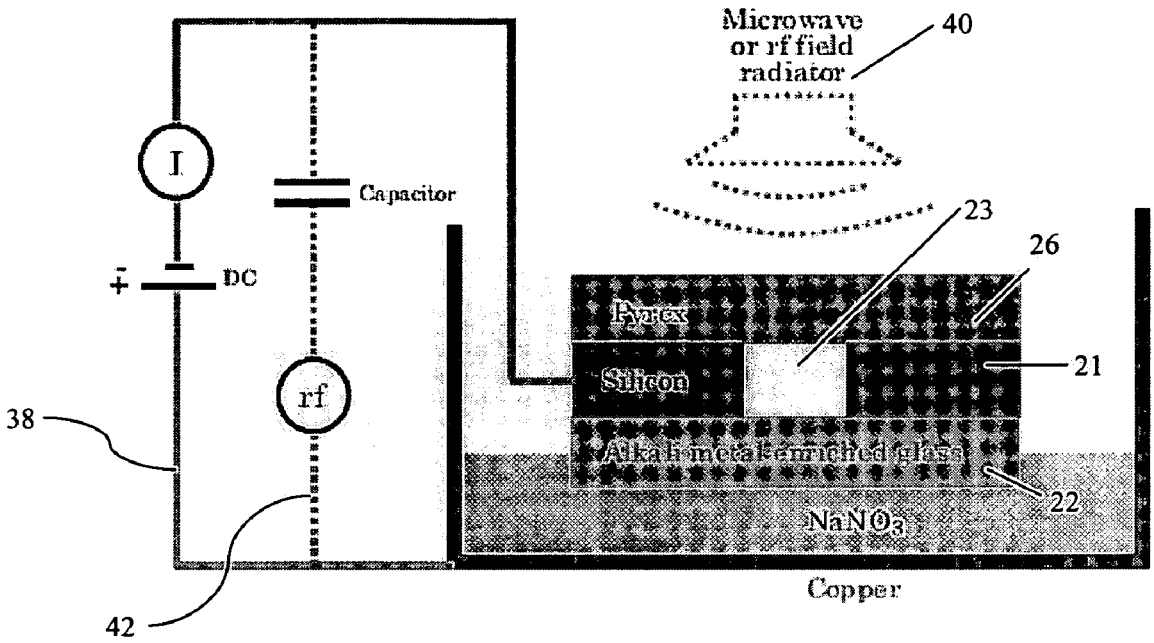
FIG. 6 is a schematic diagram of an alternate embodiment for electrolytic cell filling.

FIG. 6 illustrates an alternate embodiment for electrolytic cell filling. Microwave or rf field radiator 40 provides microwave excitation or radio frequency to maintain a plasma in the buffer gas. Alternatively, a radiofrequency voltage 42 is connected to the same conducting paths used with power supply 38.

Figure 7:
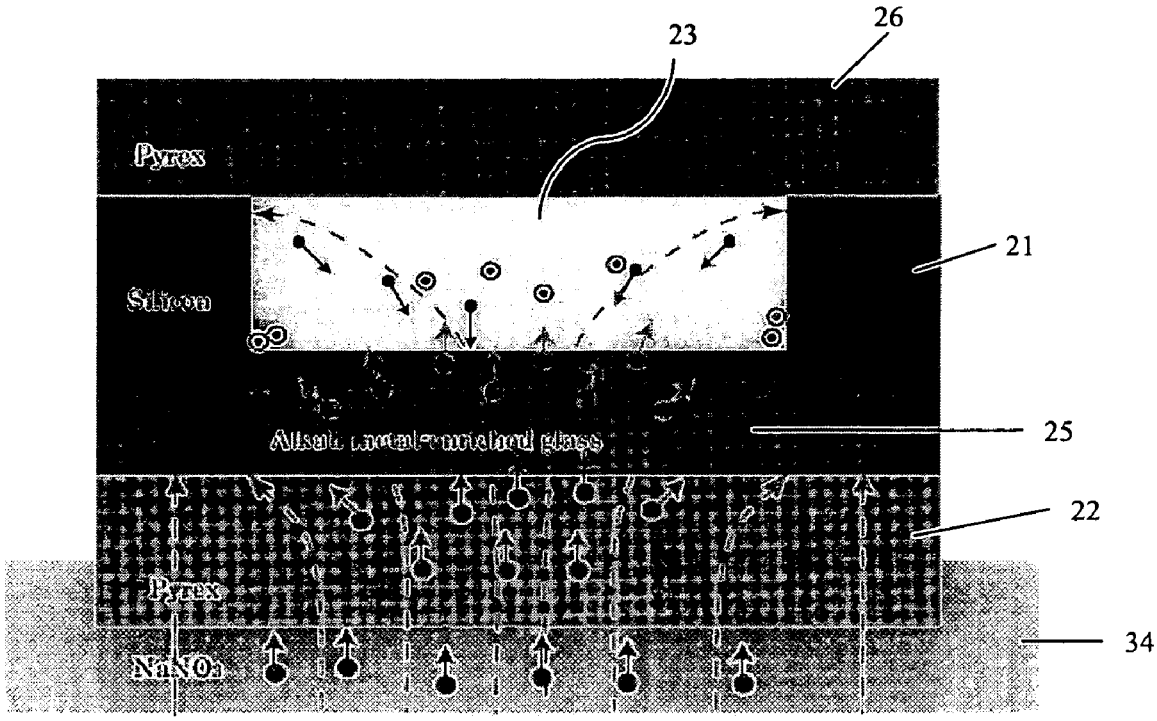
FIG. 7 is a schematic diagram of motion of alkali metal ions during the electrolysis process.

FIG. 7 illustrates motion of alkali metal ions during the electrolysis process. Molten salt 34 has a positive electrostatic potential with respect to silicon layer 21 and an electric field is established in glass layer 22. Electrons move from silicon layer 21 (cathode) to alkali metal enriched glass 25 and combine with alkali metal ions to form alkali metal atoms. Ions close to the silicon-glass interface can be reduced to free alkali-metal atoms by direct electron transfer from silicon layer 21. If a plasma is maintained in the buffer gas, as shown in FIG. 6, electrons from the plasma by indirect contact can reduce ions near the center of the window. Referring to FIG. 7, as the desired ions, for example, $Rb^+$ or $Cs^+$, are reduced, they are replaced by underlying ions, these are replaced, in turn, by $Na^+$ ions from glass layer 22 and finally, $Na^+$ ions from molten salt 34 move into glass layer 22. The oxidized products of the salt are released as nitrogen or oxygen gas or they make oxide deposits.

Figure 8:
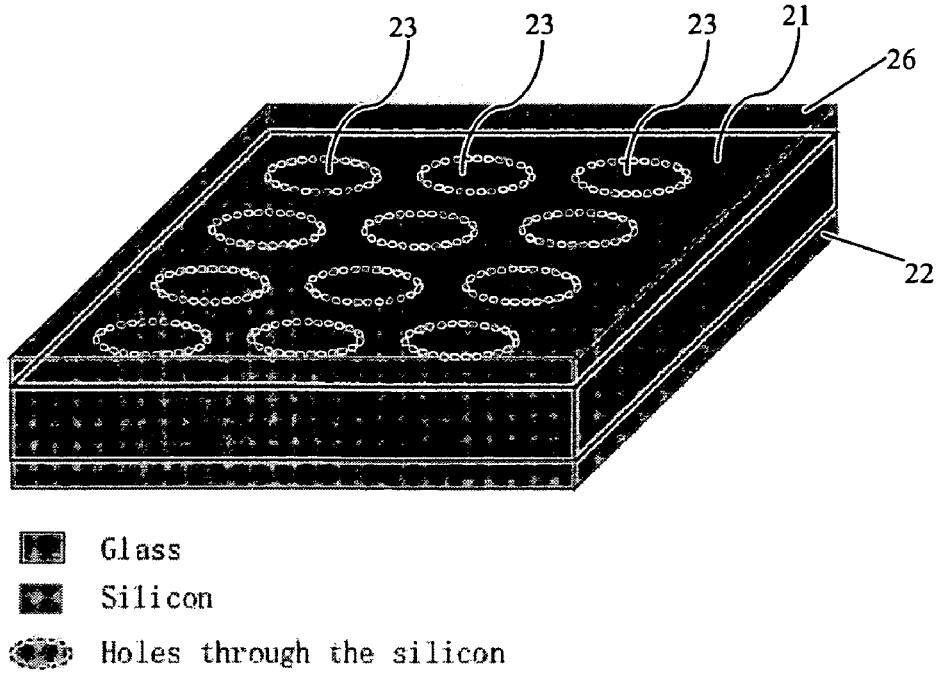
FIG. 8 is an embodiment including a silicon layer having a plurality of holes.

FIG. 8 illustrates an embodiment of cell 50 comprising silicon layer 21 including a plurality of holes 23. Silicon layer 21 is anodically bonded to glass layer 22. Holes 23 can be formed in silicon layer 21 by methods of drilling, photolithographic patterning, selective chemical etching, deep reactive ion etching, and the like. Each of holes 23 of cell 50 containing alkali metal can be separated from one another to form an individual alkali metal vapor cell. The individual vapor cells can be used for an atomic clock or atomic magnetometer and other devices that use alkali-metal vapor in a cell. It is desirable that the majority of the electrolytic current be used to reduce $Cs^+$ ions to Cs atoms in the cell, and that the concomitant reduction of $Na^+$ ions to Na atoms in the anodic bond be minimized. It is appreciated that the bond can be compromised if too many Na atoms are reduced there, as described in K. B. Albaugh, Materials Letters 4, p. 465 (1986); and M. M. Visser et al., M. Micormech. Microeng. 11, p. Ni (2001), hereby incorporated by reference into this application. Two methods of the present invention were used to guide most of the current to the alkali metal enriched glass. In a first method, the current was localized by using a small-diameter ion anode. In one embodiment, the diameter of the ion anode was equal to or less than the thickness of glass layer 22. For example, the ion anode can have a diameter in the range of about 1 mm to about 5 mm. In a second method, the use of a molten salt provided good thermal contact to the glass, and permitted the glass above the anode to be kept hotter and more highly conducting than for the surrounding glass.

Figures 9A, 9B, 9C:
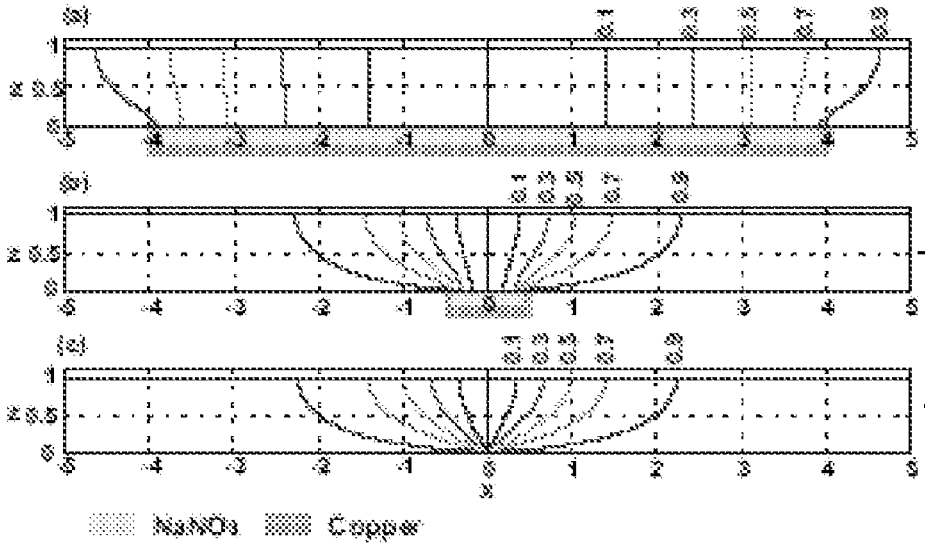
FIG. 9A is a schematic diagram of distribution of current from an ion anode to a silicon cathode through a glass plate. The diameter of the ion anode is 8d.
FIG. 9B is a schematic diagram of distribution of current from an ion anode to a silicon cathode through a glass plate. The diameter of the ion anode is d.
FIG. 9C is a schematic diagram of distribution of current from an ion anode to a silicon cathode through a glass plate. The diameter of the ion anode is negligibly small compared to d.

In FIGS. 9A-9C, calculated current distributions from a circular ion anode, through a glass plate, to a silicon cathode of cell 20 are shown. The horizontal coordinate is the distance from the center of the glass. The vertical coordinate is the height from the bottom of the glass. Both distances are given in units of the plate thickness, d. Constant conductivity, $\sigma$, was assumed in the glass, and a current density $j=-\sigma\nabla\phi$, where $\phi$ is the electrostatic potential. $\phi=\phi(r,z)$ was found as the axially symmetric solution to Laplace's equation $\nabla^2\phi=0$ in cylindrical coordinates r, $\theta$, z. The coordinate system is centered on the ion anode. At the bottom of the glass plate z=0; at the top, z=d. The boundary conditions were $\phi=0$ for the glass-silicon interface at the top and $\phi=V$ at the glass-salt interface. No current flow was assumed into the glass except through the salt, so for the parts of the bottom surface that were not in contact with the salt set $\delta\phi/\delta z=0$. The labels 0.1 . . . 0.9 indicate surfaces of revolution containing fractions 0.1 . . . 0.9 of the electrolytic current. In FIG. 9A, the diameter of the ion anode is 8d. As shown in FIG. 9A, when the diameter of the anode is much larger than the glass thickness, most of the current flows to a cathode area that is only slightly larger than the anode area. The current collection area on the cathode can be diminished by diminishing the diameter of the ion anode. FIG. 9B shows the current flow for an anode with a diameter equal to the glass thickness. In FIG. 9C, the diameter of the ion anode is negligibly small compared to d. FIG. 9C shows that the collection area for a "point-source" anode is only slightly smaller than that of the finite anode of FIG. 9B. As described above, there will be further concentration of the current because of higher conductivity of the hot glass above the ion anode.

The absorption of Cs resonance light generated by an external-cavity, single-mode diode laser, (Toptica DL100), was measured to show that there was free Cs metal in cell 20 made with the method of the present invention. The laser frequency was tuned to the peak of the D1 resonance line of cesium. The peak absorption of the cell for temperatures ranging from 90° C. to 130° C. was measured. The power of the transmitted light was measured with a photo diode. Let I be the intensity of the transmitted light when laser frequency is tuned to peak absorption, and let $I_0$ be the intensity of the transmitted light when there is no resonant absorption of the light from the vapor when the cell is at room temperature and vapor density is too small to cause significant absorption. Then the number density of the alkali metal atoms in the cell is $$N = \frac{\ln(I_0/I)}{\sigma L}.$$

Figure 10:
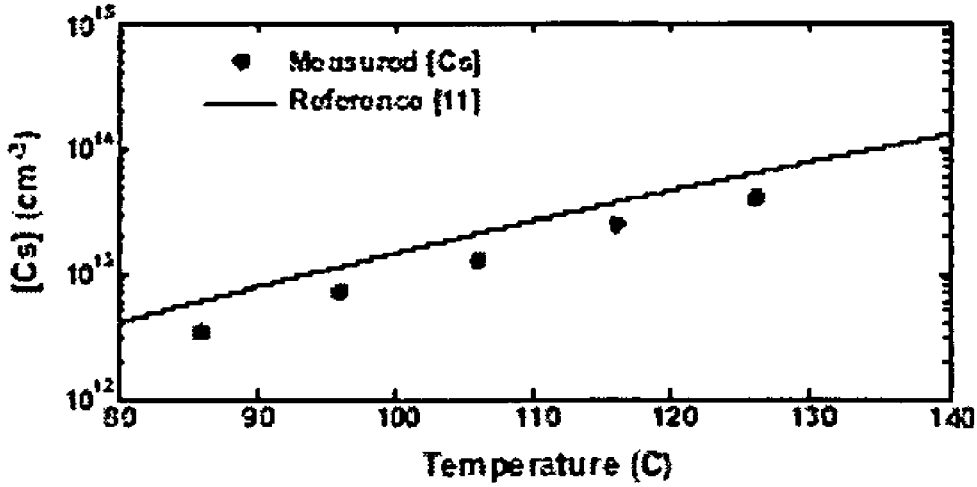
FIG. 10 is a graph of the number of density of cesium atoms in a Cs cell of the present invention and the standard number density of the Cs vapor which is in thermal equilibrium with metal.

Here L=0.25 cm is the length of vapor through which the laser beam passes. The peak absorption cross section, as described in Romalis et al. Phys. Rev. A 56, p. 4569 (1997), $\sigma=4.0\times10^{-13}$ $cm^2$, for Cs atoms in 0.4 amg of Ar is nearly independent of temperature. All the cells have been measured and all of them have Cs inside. One of the results of these measurements is shown as points in FIG. 10. The continuous curve is the number density of Cs vapor in equilibrium with pure liquid Cs as described in A. N. Nesmeyanov, Vapor Pressure of the Elements (Academic Press, 1963). The density of Cs vapor in the electrolytically filled cell is very nearly equal to the saturated number density.

Figure 11:
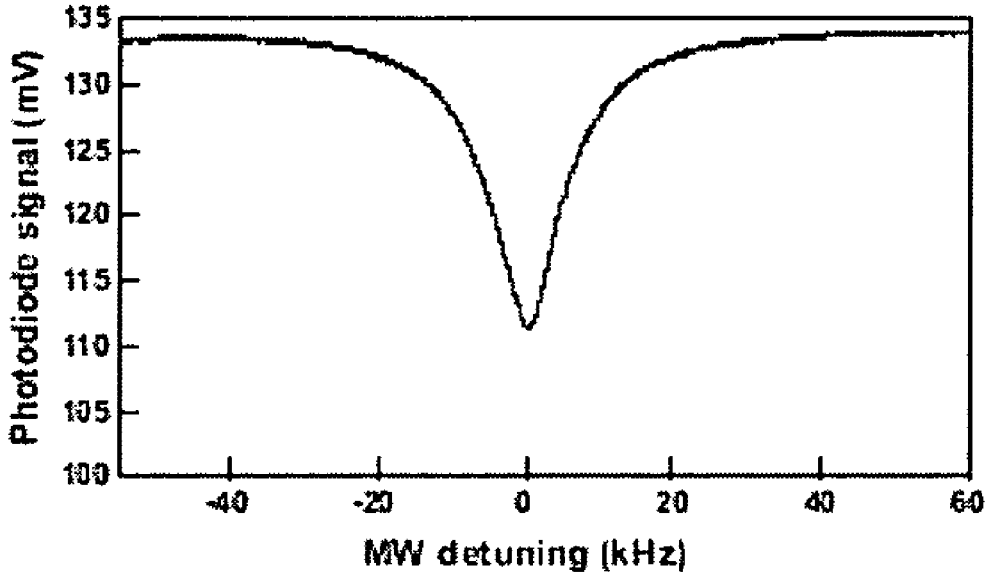
FIG. 11 is a graph of a microwave end resonance.

The electrolytically-filled cells can be optically pumped. For example, a microwave end resonance, as described in Jau et al., Phys. Rev. Lett. 92, p. 110801 (2004), hereby incorporated by reference into this application, from one of the cells is shown in FIG. 11. Cell 20 was pumped with 7.6 $mW/cm^2$ of circularly polarized light from the same diode laser used to make the density measurements of FIG. 10. The transmitted light was measured with a photodiode. The microwaves came from a horn antenna. The full width at half maximum is 12.3 kHz; on resonance the transmission decreased by 16.7%, the resonance frequency was 9.19314 GHz, the static field was 0.13 G, the temperature was 110° C.

The invention can be further illustrated by the following examples thereof, although it will be understood that these examples are included merely for purposes of illustration and are not intended to limit the scope of the invention unless otherwise specifically indicated. All percentages, ratios, and parts herein, in the Specification, Examples, and Claims, are by weight and are approximations unless otherwise stated.

EXAMPLES

Example 1

Figure 12:
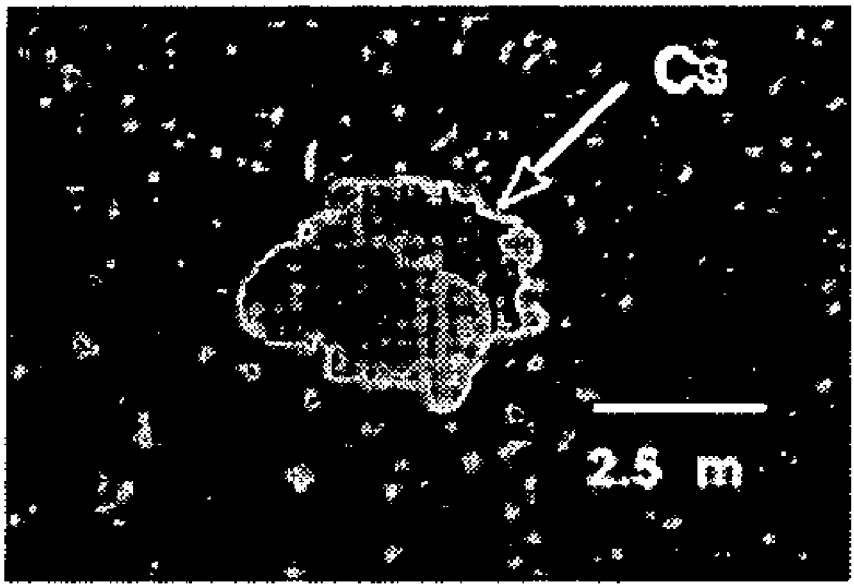
FIG. 12 is a photograph of a cell after electrolysis was performed.

Electrolysis was performed for several minutes using a cell as shown in FIG. 5, sufficient time for a film of yellow Cs metal to form on the top window of the cell 20 and to coalesce into droplets. When the cell cooled, much of the Cs metal recondensed on the silicon sidewalls of the cell. A photograph of the top of the cell is shown in FIG. 12.

Example 2

Figure 13:
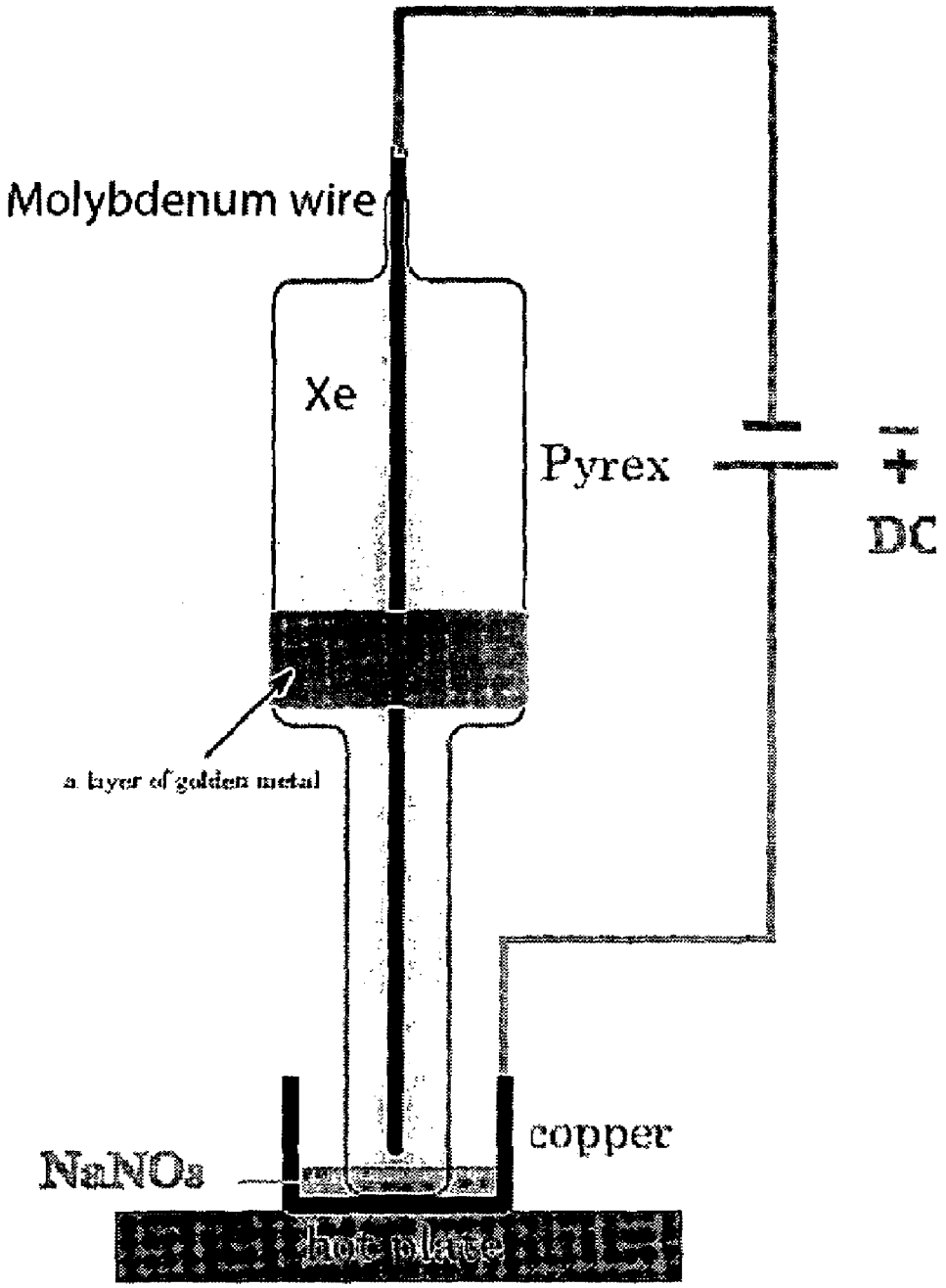
FIG. 13 is a schematic diagram of an experimental arrangement for illustrating the method of the present invention.

A cell was made to demonstrate that the electrolysis method can be used to fill Pyrex glass cells with cesium metal. The cells for our initial experiments were made by traditional glass-blowing methods. An experimental arrangement is shown in FIG. 13. A piece of Mo wire was sealed in the glass and used as a cathode to replace the silicon cathode. The anode was a copper crucible. The cell was filled with xenon buffer gas at a room temperature pressure of about 10 torr. During the manufacture of the cell, a layer of Cs-enriched borate glass was fused to the bottom interior surface for use of alkali metal glass 24. The space between the tip of the Mo wire and the borate glass was about 0.5 cm. A DC voltage was applied between the copper crucible and the molybdenum wire. At about 1000V, the gas broke down and a gaseous discharge current was established between the molybdenum wire and the glass. At this point, the voltage could be lowered to about 200V without extinguishing the discharge, and this voltage maintained a stable, 7 mA current through the cell. The molten salt temperature was about 500° C. After electrolyzing for about 15 minutes, a layer of metal could be seen in the inner surfaces of the cell. A yellow flame from a glass-blower's torch was used to move the metal distillate to a higher location in the cell, where it condensed as tiny golden droplets, very similar in appearance to Cs metal.

It was demonstrated that the metal in the cell was Cs by warming the cell and showing that light from a diode laser tuned closer to the 894 nm resonance line of Cs, was strongly absorbed when it passed through the cell.

By quantitatively measuring the absorption of light, the number of density of Cs atoms can be determined. Let $I_{on}$ be the relative intensity of light transmitted when the laser frequency matches that of the D1 line of Cs. The D1 line comes from the excitation of $6^2S_{1/2}$ ground-state Cs atoms to the $6^2P_{1/2}$ first excited state. Let $I_{off}$ be the relative intensity of light transmitted when the laser frequency is tuned away from the D1 line. Then $I_{on}/I_{off}=e^{-\sigma NL}$. Here, σ is the cross section for absorbing photons at the peak of the D1 line, N is the number density of the alkali metal atoms in the cell, L is the length of vapor through which the laser beam passes, The Cs number density is therefore $$N = \frac{1n(I_{off}/I_{on})}{\sigma L}.$$

Figure 14:
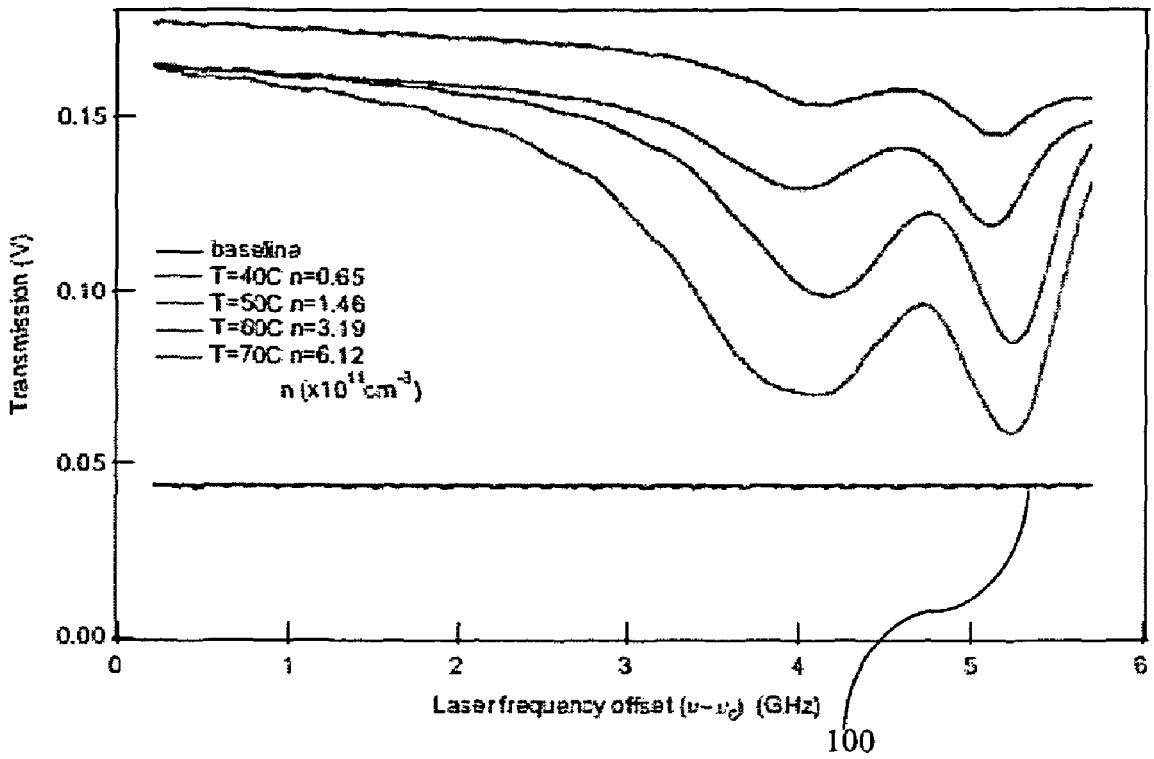
FIG. 14 is a graph of transmission intensity versus laser frequency at different temperature.

Therefore, by measuring the on- and off-resonance transmission intensity of the laser light, the number density of Cs in the cell at different temperature can be determined, as shown in FIG. 14. FIG. 14 is a graph of transition intensity vs. laser frequency at different temperature. Here $v_0$=335117 GHz. The number density $N=\ln(I_{off}/I_{on})/(\sigma L)$(in $cm^{-3}$) of Cs atoms in the cell can be determined by measuring the on-resonance and off-resonance transmitted intensities $I_{on}$ and $I_{off}$. Here σ is the known photon absorption cross section for a Cs atom in the buffer gas, and L is the length of a vapor through which the laser beam passes. The two-dip structure of the absorption curve is due to the optical transition from the lower hyperfine multiplets of $6^2S_{1/2}$ to the two $6^2P_{1/2}$ hyperfine multiplets. Black baseline 100 is the dark signal of the photo detector. It is shown that incident laser intensity is nearly constant over the frequency turning range. The number density of Cs vapor in the cell is about a factor of two smaller than the equilibrium value in thermal equilibrium, which is true of conventional glass cells containing Cs metal that has been introduced by vacuum distillation before the cell is sealed off, rather than by electrolysis of Cs into an already sealed-off cell, as described in the present invention.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A method for fabrication of an alkali-metal vapor cell comprising the steps of:

providing an open cell having one or more holes therein;

placing alkali metal enriched glass in each of said one or more holes;

closing said cell; and applying current from an ion enriched anode to said cell for electrolytically reducing alkali metal ions from the alkali metal enriched glass to produce free alkali metal in said closed cell to form the alkali-metal vapor cell.

2. The method of claim 1 wherein said open cell comprises a layer of silicon having a first surface anodically bonded to a first layer of glass, said layer of silicon having said one or more holes therein, said first layer of glass having one or more wells therein, said one or more holes of said silicon layer being adjacent to respective said one or more wells of said first glass layer, wherein said alkali metal enriched glass is received in said one or more holes and/or said one or more wells.

3. The method of claim 2 wherein said first layer of glass comprises $Na^+$ ions.

4. The method of claim 2 wherein said alkali metal ions of said alkali metal enriched glass ions are $Cs^+$, $Rb^+$ or $K^+$ ions.

5. The method of claim 2 wherein a diameter of said ion enriched anode is equal to or less than a thickness of said first glass layer.

6. The method of claim 1 wherein said step of closing said cell is performed by anodically bonding a second layer of glass to a second surface of said layer of silicon under a buffer gas.

7. The method of claim 6 wherein said second layer of glass comprises $Na^+$ ions.

8. The method of claim 1 wherein said alkali metal enriched glass comprises Cs enriched borate glass.

9. The method of claim 8 wherein said ion enriched anode comprises a metal base including a basin for receiving said molten salt.

10. The method of claim 8 wherein said molten salt is a $NaNO_3$ salt for replacing $Na^+$ ions with ions of the alkali metal enriched glass.

11. The method of claim 8 wherein said current provides an electric field in said closed cell and field enhanced diffusion moves ions from said molten salt into said closed cell for reducing said alkali metal ions.

12. The method of claim 1 wherein said ion enriched anode comprises a molten salt.

13. The method of claim 1 further comprising the step of:

controlling the amount of current applied for controlling the amount of alkali metal produced in said alkali-metal vapor cell.

14. The method of claim 1 wherein said alkali-metal vapor cell is used for an atomic clock.

15. The method of claim 1 wherein said alkali-metal vapor cell is used for a magnetometer.

16. A method for fabrication of cell comprising the steps of:

providing an open cell having one or more holes therein;

placing alkali metal enriched glass in each of said one or more holes;

closing said cell by anodically bonding a second layer of glass to a second surface of said layer of silicon under a buffer gas; and applying current from an ion enriched anode to said cell for electrolytically reducing alkali metal ions from the alkali metal enriched glass to produce free alkali metal in said closed cell wherein said buffer gas is one or more of argon, nitrogen, or xenon.

17. The method of claim 16 further comprising the step of:

generating plasma in said buffer gas before said step of applying current from an ion anode for electrolytic production of said free metal in a region of said one or more holes not in contact with said layer of silicon.

18. The method of claim 17 wherein said plasma is generated by the application of microwaves.

19. The method of claim 17 wherein said plasma is generated by radiofrequency energy.

20. A method for fabrication of an alkali-metal vapor cell comprising the steps of:

providing a cell comprising a layer of silicon having one or more holes therethrough, said layer of silicon being anodically bonded between a first layer of glass and a second layer of glass, said first layer of glass comprising alkali metal ions; and applying current from an ion enriched anode to said cell for electrolytically reducing said alkali metal ions to produce free alkali metal in said one or more holes of said cell to form the alkali-metal vapor cell.

21. The method of claim 20 wherein said cell further comprises a buffer gas within said one or more holes.

22. The method of claim 21 wherein said buffer gas is one or more argon, nitrogen, or xenon.

23. The method of claim 20 wherein said alkali metal ions are $Cs^+$, $Rb^+$ or $K^+$ ions.

24. The method of claim 20 wherein said first layer of glass and said second layer of glass comprises $Na^+$ ions.

25. The method of claim 20 wherein said ion enriched anode comprises a molten salt.

26. The method of claim 25 wherein said molten salt is a $NaNO_3$ salt for replacing $Na^+$ ions with ions of the alkali metal enriched glass.

27. The method of claim 25 wherein said current provides an electric field in said cell and field enhanced diffusion moves ions from said molten salt into said cell for reducing said alkali metal ions.

28. The method of claim 20 wherein a diameter of said ion enriched anode is equal to or less than a thickness of said first glass layer.

29. The method of claim 20 further comprising the step of:

controlling the amount of current applied for controlling the amount of alkali metal produced in said alkali-metal vapor cell.

30. The method of claim 20 wherein said alkali-metal vapor cell is used for an atomic clock.

31. The method of claim 20 wherein said alkali-metal vapor cell is used for a magnetometer.

32. A method for fabrication of a cell comprising the steps of:

providing a cell comprising a layer of silicon having one or more holes therethrough said cell comprising a buffer gas within said one or more holes, said layer of silicon being anodically bonded between a first layer of glass and a second layer of glass, said first layer of glass comprising alkali metal ions;

applying current from an ion enriched anode to said cell for electrolytically reducing said alkali metal ions to produce free alkali metal in said one or more holes of said cell; and generating plasma in said buffer gas before said step of applying current from an ion anode for electrolytic production of said free metal in a region of said well not in contact with said layer of silicon.

33. The method of claim 32 wherein said plasma is generated by the application of microwaves.

34. The method of claim 32 wherein said plasma is generated by radio frequency energy.

* * * * *